US011722814B2

(12) United States Patent
Kang et al.

(10) Patent No.: US 11,722,814 B2
(45) Date of Patent: Aug. 8, 2023

(54) SOUND OUTPUT APPARATUS

(71) Applicant: LG ELECTRONICS INC., Seoul (KR)

(72) Inventors: Daegee Kang, Seoul (KR); Seunghark Paek, Seoul (KR); Minkoo Kim, Seoul (KR); Seunghwan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/718,042

(22) Filed: Apr. 11, 2022

(65) Prior Publication Data

US 2023/0171538 A1 Jun. 1, 2023

(30) Foreign Application Priority Data

Nov. 29, 2021 (KR) ..... 10-2021-0167414

(51) Int. Cl.

| | |
|---|---|
| ***H04R 1/28*** | (2006.01) |
| ***H04R 1/02*** | (2006.01) |
| ***H04R 7/12*** | (2006.01) |
| ***H04R 9/02*** | (2006.01) |
| ***H04R 7/26*** | (2006.01) |
| ***H04R 9/06*** | (2006.01) |
| ***H04R 7/18*** | (2006.01) |

(52) U.S. Cl.

CPC ..... *H04R 1/288* (2013.01); *H04R 1/025* (2013.01); *H04R 7/12* (2013.01); *H04R 7/18* (2013.01); *H04R 7/26* (2013.01); *H04R 9/025* (2013.01); *H04R 9/06* (2013.01)

(58) Field of Classification Search

CPC ..... H04R 1/288; H04R 1/025; H04R 7/12; H04R 7/18; H04R 7/26; H04R 9/025; H04R 9/06

USPC ..... 381/335

See application file for complete search history.

(56) References Cited

U.S. PATENT DOCUMENTS

| | | | | |
|---|---|---|---|---|
| 2008/0044044 | A1* | 2/2008 | Madaffari | H04R 9/025 381/186 |
| 2015/0139464 | A1* | 5/2015 | Guo | H04R 1/04 381/334 |
| 2017/0064421 | A1* | 3/2017 | Matsumura | H04R 1/2896 |
| 2021/0243520 | A1* | 8/2021 | Nakajima | H04R 1/025 |
| 2023/0008436 | A1* | 1/2023 | Chang | H04R 1/227 |

* cited by examiner

*Primary Examiner* — Sean H Nguyen

(74) *Attorney, Agent, or Firm* — Lee, Hong, Degerman, Kang & Waimey PC

(57) ABSTRACT

Disclosed herein is a sound output apparatus including a case including a hole, and a speaker unit including a first speaker unit and a second speaker unit, wherein the first speaker unit and the second speaker unit are mounted on the case through the hole, spaced apart from each other by a preset distance, and symmetrically arranged, wherein the first speaker unit and the second speaker unit output sound in opposite directions.

13 Claims, 9 Drawing Sheets

SOUND OUTPUT APPARATUS

CROSS-REFERENCE TO RELATED APPLICATIONS

Pursuant to 35 U.S.C. § 119(a), this application claims the benefit of earlier filing date and right of priority to Korean Patent Application No. 10-2021-0167414, filed on Nov. 29, 2021, the contents of which are all hereby incorporated by reference herein in its entirety.

BACKGROUND OF THE DISCLOSURE

Field of the Disclosure

Embodiments relate to a sound output apparatus. For example, the embodiments are applied to a sound output apparatus including two or more speaker units.

Discussion of the Related Art

Recently, there has been an increasing trend of numerous households in a single residential building, such as an apartment building, a studio apartment building, or a town house.

Also, with the development of science and technology, an increasing number of users enjoy sound by connecting sound output apparatuses to portable devices such as smartphones and laptops, and stationary apparatuses such as TVs and desktops.

A sound output apparatus is a type of device that converts electrical energy into acoustic energy, and is connected to various multimedia devices in a wireless or wired manner to output sound.

Sound output apparatuses include, for example, headphones, earphones, and speakers. Headphones or earphones are a sound output apparatuses designed to be mounted on or in the ear to transmit vibrations to the eardrum of the ear to output sound without radiating sound into a space. Speakers are devices that output sound by radiating sound waves which is converted acoustic energy, into space.

Speakers use vibration to radiate sound into space. Specifically, speakers generate vibration by a magnet included in the speaker. The generated vibration is propagated through air. That is, the user recognizes the sound through the vibration generated from the speaker.

However, inconvenience may be caused by loud noise disturbing neighbors or even other people within the same household. Accordingly, there is a need for a sound output apparatus capable of that generating low vibration while maintaining high sound quality.

SUMMARY OF THE DISCLOSURE

Embodiments are directed to a sound output apparatus that substantially obviates one or more problems due to limitations and disadvantages of the related art.

Embodiments provide a sound output apparatus that generates reduced vibration.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, a sound output apparatus may include a case including a first opening and a second opening positioned on opposite sides of the case; and a first speaker mounted to the case at the first opening and the second speaker mounted to the case at the second opening such that the first speaker and the second speaker are symmetrically arranged and face opposite directions, wherein the first speaker and the second speaker are spaced apart from each other by a preset distance such that respective sound vibrations generated at a rear of the first speaker and a rear of the second speaker cancel each other out.

According to embodiments, the preset distance may be greater than a diameter of the first and second speakers.

According to embodiments, the preset distance may be greater than or equal to 1.9 times a diameter of the first and second speakers and less than or equal to 2.1 times the diameter.

According to embodiments, the preset distance may be approximately twice a diameter of the first and second speakers.

According to embodiments, a lateral depth distance of the case perpendicular to an axis of measurement of the preset distance may be greater than a diameter of the first and second speakers.

According to embodiments, the lateral depth distance may be greater than or equal to 1.25 times the diameter and less than or equal to 1.45 times the diameter.

According to embodiments, the lateral depth distance may be approximately 1.3 times the diameter.

According to embodiments, the lateral depth distance may be greater than or equal to 1.5 times the diameter and less than or equal to 1.9 times the diameter.

According to embodiments, the lateral depth distance may be approximately 1.7 times the diameter.

According to embodiments, each of the first and second speakers may include a diaphragm configured to vibrate; a plate configured to support the diaphragm; and a first magnet arranged to surround at least a portion of the plate.

According to embodiments, each of the first and second speakers may further include a second magnet disposed at a rear of the plate and arranged to face the diaphragm.

According to embodiments, each of the first and second speakers may further include a damper arranged between the diaphragm and the plate and configured to support the diaphragm.

According to embodiments, the sound output apparatus may further include a sound absorbing member provided inside the case to absorb sound generated from the first and second speakers.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION OF THE DISCLOSURE

Figure 1:
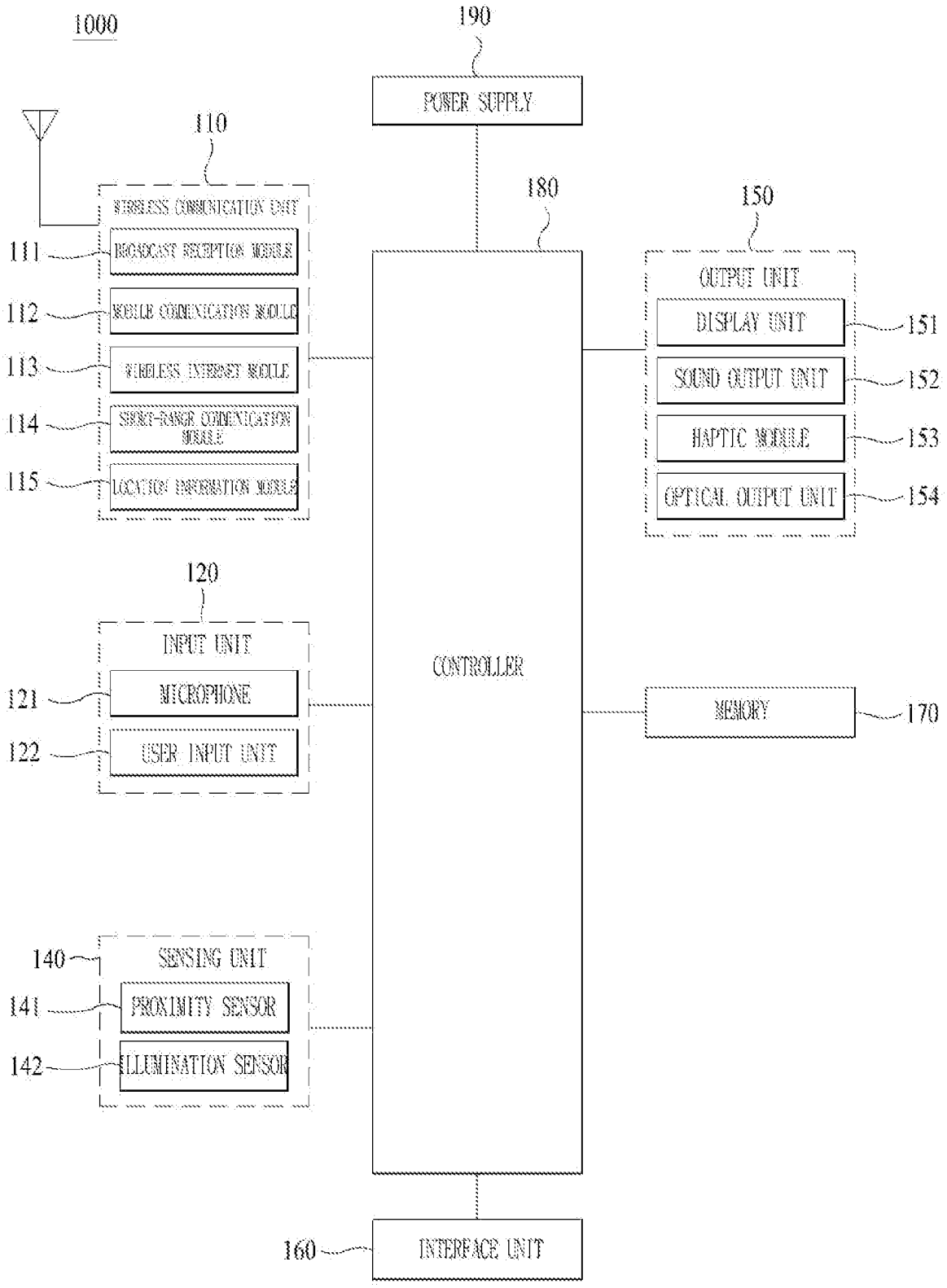
FIG. 1 is a block diagram of a sound output apparatus in accordance with the present disclosure.

Reference will now be made in detail to embodiments of the present disclosure, examples of which are illustrated in the accompanying drawings. Wherever possible, the same reference numbers will be used throughout the drawings to refer to the same or like parts, and redundant description thereof will be omitted. As used herein, the suffixes "module" and "unit" are added or used interchangeably to facilitate preparation of this specification and are not intended to suggest distinct meanings or functions.

Further, in describing the embodiments disclosed in this specification, if a detailed description of related known techniques would unnecessarily obscure the gist of the embodiments disclosed in this specification, detailed description thereof will be omitted. In addition, the attached drawings are provided for easy understanding of the embodiments disclosed in this specification and do not limit technical idea disclosed in this specification, and the embodiments should be construed as including all modifications, equivalents, and alternatives falling within the spirit and scope of the present disclosure.

Terms including ordinal numbers such as first, second, etc. may be used to explain various elements. However, it will be appreciated that the elements are not limited to such terms. These terms are merely used to distinguish one element from another. Stating that one constituent is "connected" or "linked" to another constituent should be understood as meaning that the one constituent may be directly connected or linked to the other constituent or another constituent may be interposed between the constituents.

On the other hand, stating that one constituent is "directly connected" or "directly linked" to another should be understood as meaning that no other constituent is interposed between the constituents. As used herein, the singular forms "a", "an", and "the" include plural referents unless context clearly dictates otherwise. In this specification, terms such as "includes" or "has" are intended to indicate existence of characteristics, figures, steps, operations, constituents, components, or combinations thereof disclosed in the specification. The terms "includes" or "has" should be understood as not precluding possibility of existence or addition of one or more other characteristics, figures, steps, operations, constituents, components, or combinations thereof. The terms "around" or "approximately" or "substantially" or the like, when used in reference to measurements or comparisons of certain discussed values, distances, lengths, or the like, shall be understood to refer to the general acceptable range of values which would be considered sufficiently equal or comparable to by one of ordinary skill in the art in order to achieve the stated goals of the disclosure, and shall at a minimum, be understood to consider and appreciate relevant manufacturing tolerances as applicable for the general art.

A sound output apparatus described in this specification includes any device configured to output a sound signal based on an electrical signal including sound information through vibration. The sound output apparatus may include both a device to output only audio based on an input electrical signal and a device to output audio, and an image, or the like based on an input electrical signal. For example, a sound output apparatus may include an audio device such as a speaker and a multimedia device such as a TV, mobile terminal display, or a monitor.

FIG. 1 is a block diagram of a sound output apparatus in accordance with the present disclosure.

The sound output apparatus 1000 is shown as having components such as a wireless communication unit 110, an input unit 120, a sensing unit 140, an output unit 150, an interface unit 160, a memory 170, a controller 180, and a power supply 190. It is to be understood that implementing all the illustrated components is not a requirement, and that more or fewer components may alternatively be implemented.

Figure 2:
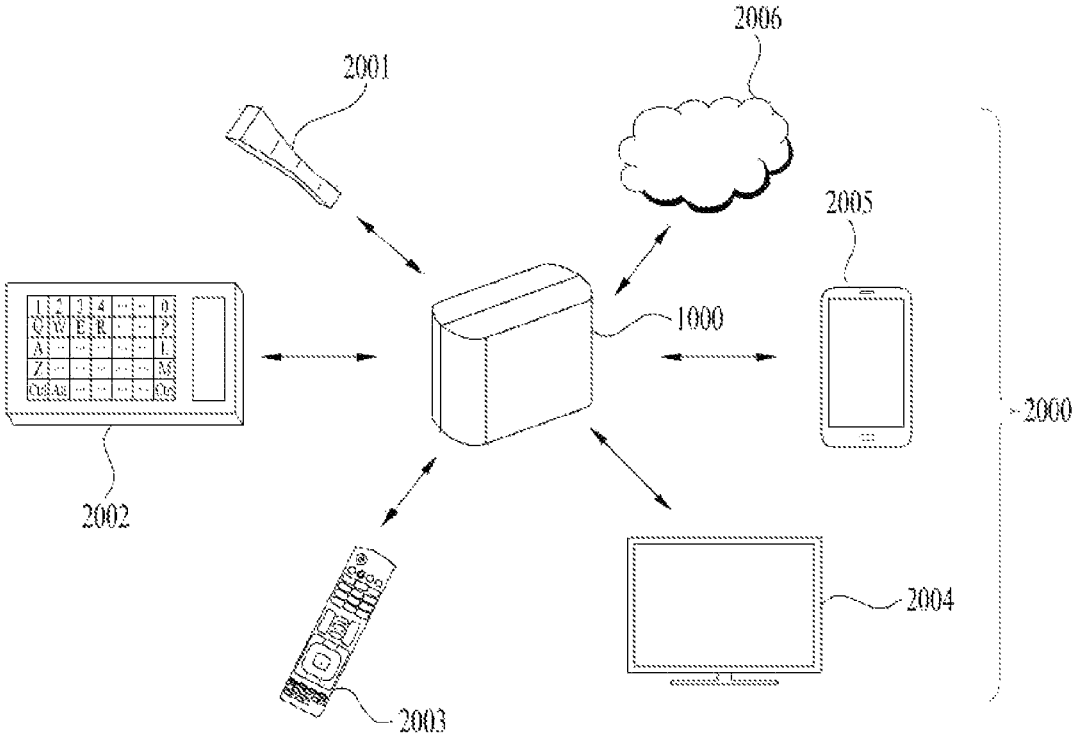
FIG. 2 illustrates external devices capable of outputting sound through the sound output apparatus according to embodiments.

The communication unit 110 according to the embodiments may include one or more modules configured to enable wired or wireless communication between the sound output apparatus 1000 and a multimedia device, between the sound output apparatus 1000 and a wired/wireless communication system, between the sound output apparatus 1000 and other sound output devices, or between the sound output apparatus 1000 and an external device 2000 (see FIG. 2). the sound output apparatus 1000 and an external device 2000 (refer to FIG. 2). The communication unit 110 may also include one or more modules configured to connect the sound output apparatus 1000 to one or more networks.

However, it will be easily understood by those skilled in the art that any new type of multimedia device capable of wireless communication which will be developed later can communicate with the sound output apparatus 1000 according to the embodiments through the communication unit 110.

The communication unit 110 may include at least one of a broadcast reception module 111, a mobile communication module 112, a wireless Internet module 113, a short-range communication module 114, and a location information module 115.

The broadcast reception module 111 receives a broadcast signal and/or broadcast-related information from an external broadcast management server on a broadcast channel. The broadcast channel includes a satellite channel and a terrestrial channel. Two or more of the broadcast reception modules may be provided in the sound output apparatus 100 for simultaneous broadcast reception or broadcast channel switching for at least two broadcast channels.

The mobile communication module 112 may transmit and/or receive wireless signals to and from one or more network entities. Typical examples of a network entity include a base station, an external mobile terminal, a server, and the like. Such network entities form part of a mobile communication network, which is constructed according to technical standards or communication methods for mobile communications (for example, Global System for Mobile Communication (GSM), Code Division Multi Access (CDMA), CDMA2000 (Code Division Multi Access 2000), EV-DO (Enhanced Voice-Data Optimized or Enhanced Voice-Data Only), Wideband CDMA (WCDMA), High Speed Downlink Packet access (HSDPA), HSUPA (High Speed Uplink Packet Access), Long Term Evolution (LTE), LTE-A (Long Term Evolution-Advanced), and the like).

The wireless signal includes various types of data according to transmission/reception of a voice signal, a video call signal, or a text/multimedia message.

The wireless Internet module 113 is configured to facilitate wireless Internet access. This module may be internally or externally coupled to the sound output apparatus 1000. The wireless Internet module 113 may transmit and/or receive wireless signals via communication networks according to wireless Internet technologies.

Examples of such wireless Internet access include Wireless LAN (WLAN), Wireless Fidelity (Wi-Fi), Wi-Fi Direct, Digital Living Network Alliance (DLNA), Wireless Broadband (WiBro), Worldwide Interoperability for Microwave Access (WiMAX), High Speed Downlink Packet Access (HSDPA), HSUPA (High Speed Uplink Packet Access), Long Term Evolution (LTE), LTE-A (Long Term Evolution-Advanced), and the like.

The wireless Internet module 113 may transmit/receive data according to one or more of such wireless Internet technologies, and other Internet technologies as well.

In some embodiments, when the wireless Internet access is implemented according to, for example, WiBro, HSDPA, HSUPA, GSM, CDMA, WCDMA, LTE, LTE-A and the like, as part of a mobile communication network, the wireless Internet module 113 performs such wireless Internet access. As such, the Internet module 113 may cooperate with, or function as, the mobile communication module 112.

The short-range communication module 114 is configured to facilitate short-range communications. Suitable technologies for implementing such short-range communications include Bluetooth™, Radio Frequency IDentification (RFID), Infrared Data Association (IrDA), Ultra-WideBand (UWB), ZigBee, Near Field Communication (NFC), Wireless-Fidelity (Wi-Fi), Wi-Fi Direct, Wireless Universal Serial Bus (USB), and the like.

The short-range communication module 114 in general supports wireless communications between the sound output apparatus 1000 and a wireless communication system, communications between the sound output apparatus 1000 and another sound output apparatus 1000, or communications between the sound output apparatus and a network where another sound output apparatus 1000 (or an external server) is located, via wireless area networks. One example of the wireless area networks is a wireless personal area networks.

The location information module 115 is generally configured to detect, calculate, derive or otherwise identify a position of the sound output apparatus. As an example, the location information module 115 includes a Global Positioning System (GPS) module, a Wi-Fi module, or both.

For example, with a GPS module, the sound output apparatus 1000 may acquire the location of the sound output apparatus 1000 from a signal transmitted from a GPS satellite. As another example, with a Wi-Fi module, the sound output apparatus may acquire the location of the sound output apparatus based on the information of a wireless access point (wireless AP) configured to transmit or receive wireless signals to or from the Wi-Fi module. Alternatively or additionally, the location information module 115 may perform any function of the other modules of the communication unit 110 to acquire data about the location of the sound output apparatus, if necessary.

The location information module 115 is a module used to acquire the location (or current location) of the sound output apparatus, but is not limited to a module that directly calculates or acquires the location of the sound output apparatus.

The input unit 120 includes an image input unit (not shown), a microphone 121 or audio input unit (not shown) for inputting an audio signal, and a user input unit 122 (e.g., a touch key, a mechanical key, etc.) for receiving information from a user. The voice data or image data collected through the input unit 120 is analyzed and processed as a user control command.

The microphone 122 processes an external sound signal in electrical voice data. The processed voice data may be variously utilized according to a function performed by the sound output apparatus 1000 (or an executed application program).

When necessary, the microphone 121 may include assorted noise removing algorithms to remove unwanted noise generated in the course of receiving the external audio.

The user input unit 122 is a component that permits input by a user. Such user input may enable the controller 180 to control operation of the sound output apparatus 1000.

The user input unit 122 may include one or more of a mechanical input element (for example, a key, a button located on a front and/or rear surface or a side surface of the sound output apparatus 1000, a dome switch, a jog wheel, a jog switch, and the like), or a touch-sensitive input, among others. As one example, the touch-sensitive input may be a virtual key or a soft key, which is displayed on a touch screen through software processing, or a touch key which is located on the sound output apparatus at a location that is other than the touch screen. On the other hand, the virtual key or the visual key may be displayed on the touch screen in various shapes, for example, graphic, text, icon, video, or a combination thereof.

The sensing unit 140 is typically implemented using one or more sensors configured to sense internal information of the sound output apparatus, the surrounding environment of the sound output apparatus 1000, user information, and the like.

For example, the sensing unit 140 may alternatively or additionally include other types of sensors or devices, such as a proximity sensor 141 and an illumination sensor 142, a touch sensor, an acceleration sensor, a magnetic sensor, a G-sensor, a gyroscope sensor, a motion sensor, an RGB sensor, an infrared (IR) sensor, a finger scan sensor, a ultrasonic sensor, a microphone 121, a battery gauge, an environment sensor (for example, a barometer, a hygrometer, a thermometer, a radiation detection sensor, a thermal sensor, and a gas sensor, among others), and a chemical sensor (for example, an electronic nose, a health care sensor, a biometric sensor, and the like), to name a few.

The sound output apparatus 1000 may be configured to utilize information obtained from sensing unit 140, and in particular, information obtained from one or more sensors of the sensing unit 140, and combinations thereof.

The output unit 150 is configured to generate an output such as a visible output, an audible output, or a tactile output. The output unit 150 includes at least one of a display unit 151, a sound output unit 152, a haptic module 153, or an optical output unit 154.

The display unit 151 may be implemented forming a layer structure with a touch sensor or being integrated with the touch sensor. An exterior of the sound output apparatus 1000 may function as a user input unit 123 to provide an input interface between the sound output apparatus 1000 and a user, and provide an output interface between the sound output apparatus 1000 and the user. For example, the display unit 151 may be formed on an exterior surface (e.g., a main body 1110, which will be described later) of the sound output apparatus 1000 to display, for example, icons and texts.

The sound output unit 152 may output audio data received from the communication unit 110 or stored in the memory 170 in a call signal reception mode, a call mode, a recording mode, a voice recognition mode, a broadcast reception mode, or the like. The sound output unit 152 may also output a sound signal related to a function (e.g., a call signal reception sound, a message reception sound, etc.) performed by the sound output apparatus 1000. The sound output unit 152 may include a receiver, a speaker, and a buzzer. The sound output unit 152 will be described in detail with reference to FIGS. 2 to 9.

The haptic module 153 may be configured to generate various tactile effects that a user feels, perceives, or otherwise experiences. A typical example of a tactile effect generated by the haptic module 153 is vibration. The strength, pattern and the like of the vibration generated by the haptic module 153 may be controlled by user selection or setting by the controller. For example, the haptic module 153 may output different vibrations in a combining manner or a sequential manner.

The optical output module 154 may output a signal for indicating occurrence of an event using light of a light source. Examples of events that may occur in the sound output apparatus 1000 may include message reception, call signal reception, a missed call, an alarm, a schedule notice, an email reception, information reception through an application, and the like.

The interface unit 160 serves as an interface with various types of external devices that may be coupled to the sound output apparatus 1000. The interface unit 160, for example, may include any of wired or wireless ports, external power supply ports, wired or wireless data ports, memory card ports, ports for connecting a device having an identification module, audio input/output (I/O) ports, video I/O ports, earphone ports, and the like.

In some cases, the sound output apparatus 1000 may perform various control functions associated with a connected external device, in response to the external device being connected to the interface unit 160.

The memory 170 is typically implemented to store data to support various functions or features of the sound output apparatus 1000.

For instance, the memory 170 may be configured to store application programs executed in the sound output apparatus 1000, data or instructions for operations of the sound output apparatus 1000, and the like. Some of these application programs may be downloaded from an external server via wireless communication. Other application programs may be installed within the sound output apparatus 1000 at time of manufacturing or shipping, which is typically the case for basic functions of the sound output apparatus 1000 (for example, outputting sound, and the like).

It is common for application programs to be stored in the memory 170, installed in the sound output apparatus 1000, and executed by the controller 180 to perform an operation (or function) for the sound output apparatus 1000.

The memory 170 includes at least one of a volatile storage medium and a non-volatile storage medium. The memory 170 is at least one of a read only memory (ROM) and a random access memory (RAM).

The controller 180 typically functions to control overall operation of the sound output apparatus 1000, in addition to the operations associated with the application programs. The controller 180 may provide or process information or functions appropriate for a user by processing signals, data, information and the like, which are input or output, or activating application programs stored in the memory 170.

To drive the application programs stored in the memory 170, the controller 180 may control a predetermined number of the components mentioned above with reference to FIG. 1. Moreover, the controller 180 may be implemented to operate two or more of the components provided in the sound output apparatus 1000 together to drive the application programs.

The controller 180 is, for example, a general processor such as a central processing unit (CPU), and is embedded in the sound output apparatus 1000. However, the controller 180 may not be physically positioned inside the sound output apparatus 1000, and may control the sound output apparatus 1000 through the communication unit 110.

The power supply 190 may be configured to receive external power or provide internal power in order to supply appropriate power required for operating elements and components included in the sound output apparatus 1000. The power supply 190 may include a battery, and the battery may be configured to be embedded in the terminal body, or configured to be detachable from the terminal body.

Some or more of the components may be operated cooperatively to embody an operation, control or a control method of the sound output apparatus in accordance with embodiments of the present disclosure. Also, the operation, control or control method of the sound output apparatus may be realized on the sound output apparatus by driving of one or more application problems stored in the memory 170.

FIG. 2 illustrates external devices that are connected to the sound output apparatus according to embodiments.

External devices 2000 shown in FIG. 2 may be connected to the sound output apparatus 1000 through the communication unit 110 in a wired or wireless manner. The sound output apparatus 1000 is controlled by the user through the input unit 120, controlled by the controller 180 according to a command pre-stored in the memory 170, or controlled through the communication unit 110 by the external devices 2000 shown in FIG. 2.

The external device 2000 may be a user interface device (UID) capable of wired and wireless communication, and includes, for example, a pointing device 2001, a keyboard 2002, and a remote control 2003 and a touch-pad implemented for the purpose of controlling the sound output apparatus 1000. The external device 2000 may also include a control means for exclusive use as an external input connected to the sound output apparatus 1000.

Alternatively, the external device 2000 includes multimedia devices including a TV 2004 and a smartphone 2005 that control the sound output apparatus 1000 through mode switching, but are not solely intended for the purpose of controlling the sound output apparatus 1000. The external device 2000 also includes an unspecified external server 2006 capable of wired or wireless communication with the sound output apparatus 2000.

The pointing device 2001 is equipped with a gyro sensor or the like to implement a pointer to the screen of the sound output apparatus 1000 according to a user's movement, pressure, rotation, and the like to transmit a predetermined control command to the sound output apparatus 1000. In this case, the sound output apparatus 1000 may include a visual input means or a display. The pointing device 2001 may be called by various names, such as a magic remote control or a magic controller.

The keyboard 2002 may be an intelligent integrated digital device configured to provide various services such as a web browser, an application, and a social network service (SNS). In some embodiments, it may not be easy to control all functions of the sound output apparatus 1000 with a remote control (e.g., the remote control 2003) alone. Thus, in some embodiments, the keyboard 2002 may be implemented to further facilitate control of the sound output apparatus 1000.

The remote control 2003 refers to a general input means provided with various key buttons necessary for control of the sound output apparatus 1000.

External device implemented for the main purpose of controlling the sound output apparatus 1000, such as the pointing device 2001, the keyboard 2002, and the remote controller 2003, may include a touchpad as necessary to provide more convenient and various control functions such as inputting text, moving a pointer, and zooming in/out photos or videos.

The multimedia devices (e.g., the devices 2004 and 2005) may include, for example, a mobile phone, a smartphone, a laptop computer, a digital broadcasting terminal, a personal digital assistant (PDA), a portable multimedia player (PMP), a navigation system, a slate PC, a tablet PC, an ultrabook, a digital TV, and a desktop computer.

Hereinafter, the sound output apparatus 1000 including all or part of the components described with reference to FIG. 1 and capable of wired or wireless communication with the external devices 2000 described with reference to FIG. 2 will be described in detail.

Figure 3:
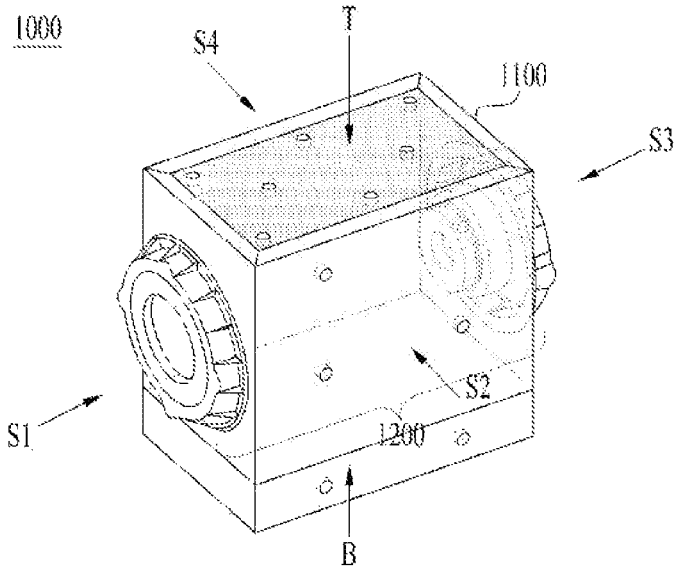
FIG. 3 is a schematic diagram illustrating each surface of the sound output apparatus according to embodiments.

FIG. 3 is a schematic diagram illustrating the sound output apparatus according to an embodiment.

The sound output apparatus 1000 according to the embodiment includes a case 1100 and a speaker unit 1200. The sound output apparatus 1000 outputs sound through the speaker unit 1200.

The sound output apparatus 1000 illustrated in FIG. 3 has a hexahedral shape as an example. Hereinafter, for simplicity, a surface of the sound output apparatus 1000 that faces the ground when the sound output apparatus 1000 is placed or installed is referred to as a bottom surface B. Another surface of the sound output apparatus 1000 opposite to the bottom surface B is referred to as a top surface T. Also, the surfaces connecting the top surface T and the bottom surface B are called lateral surfaces S1, S2, S3, and S4. However, it will be understood that the orientation of the sound output apparatus 1000 is not limited to these descriptions of the surfaces.

The lateral surfaces S1, S2, S3, and S4 include two short lateral surfaces S1 and S3 and two long lateral surfaces S2 and S4. The speaker units 1200 are installed on the short lateral surfaces S1 and S3, respectively. The speaker units 1200 provided on the short lateral surfaces S1 and S3 are symmetrically installed opposite to each other. The long lateral surfaces S2 and S4 have a width greater than that of the short lateral surfaces S1 and S3. The speaker unit 1200 is not installed on the long lateral surfaces S2 and S4 in this embodiment.

In the sound output apparatus 1000, the case 1100 defines a closed or at least partially open space by the bottom surface B, the top surface T, and the lateral surfaces S1, S2, S3, and S4.

The shape of the sound output apparatus 1000 shown in FIG. 3 is merely an example. For example, the sound output apparatus 1000 may have a hexahedral shape and include a pair of speaker units on each of the short lateral surfaces and the long lateral surfaces, respectively. In this case, the width of the short lateral surfaces is less than or equal to the width of the long lateral surfaces. Hereinafter, for simplicity, the sound output apparatus 1000 having a rectangular parallelepiped shape shown in FIG. 3 will be described as an example.

Figure 4:
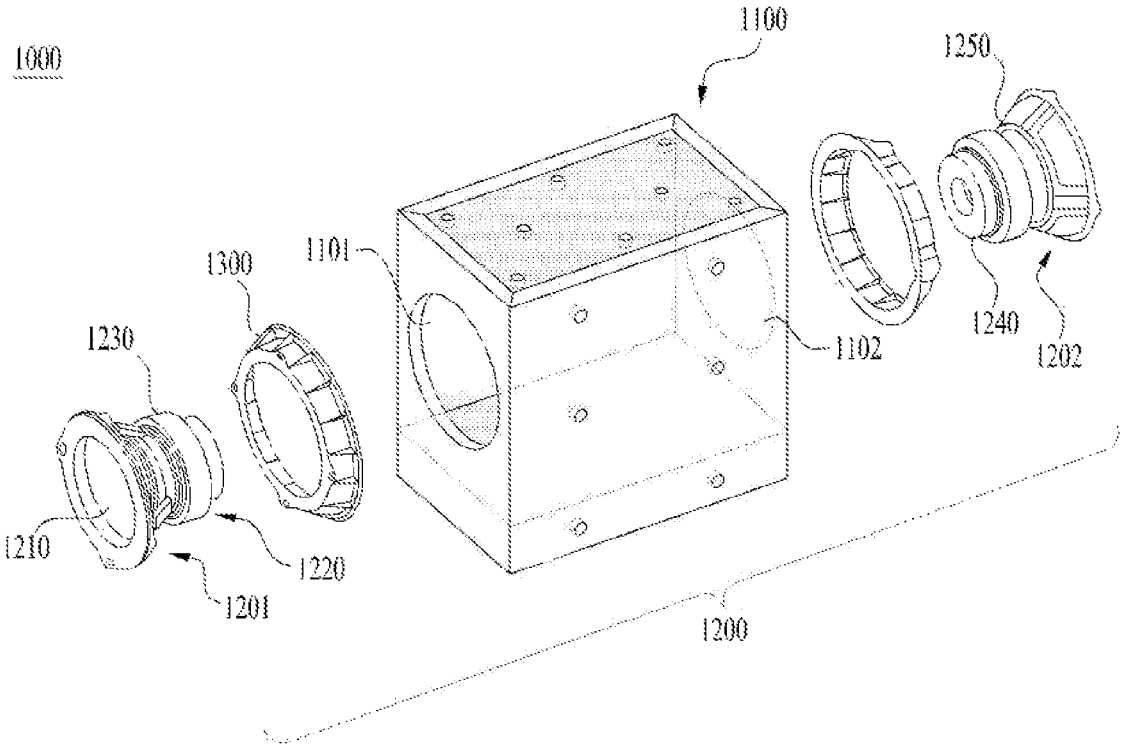
FIG. 4 is an exploded view of the sound output apparatus according to embodiments.

FIG. 4 is an exploded view of the sound output apparatus according to embodiments.

The sound output apparatus 1000 according to the embodiments includes a case 1100 including holes 1101 and 1102, and a speaker unit 1200 provided in the case 1100 to output sound.

The case 1100 according to the embodiments includes the opening, or hole, 1101. The speaker unit 1200 is mounted in the case 1100 by the hole 1101 to output sound. The case 1100 is formed to expose, through the hole 1101, a side of the speaker unit 1200 from which sound is output by the speaker unit 1200, and to surround a side of the speaker unit 1200 from which sound is not output by the speaker unit 1200.

According to this structure, the case 1100 may prevent the sound output from the front of the speaker unit 1200 and the sound output from the rear of the speaker unit 1200 from canceling each other out. The case 1100 may support efficient output of sound from the speaker unit 1200.

The case 1100 is formed such that at least a part of the inside thereof is empty. The sound output apparatus 1000 may further include a sound absorbing material (not shown) in the empty space inside the case 1100. The sound absorbing material may absorb at least a portion of the sound generated from the speaker unit 1200. The sound absorbing material may absorb the sound output from the rear of the speaker unit 1200 to prevent the sound from being reflected back toward the speaker unit 1200.

The case 1100 forms a closed space except for the hole 1101 in which the speaker unit 1200 is provided. Thus, the sound output apparatus 1000 may output high-quality sound. However, at least a part of the case 1100 other than the hole 1101 may also be opened. Thereby, the sound output apparatus 1000 may output high-quality sound while preventing occurrence of internal defects.

The speaker unit 1200 converts an electrical signal into a sound signal. The sound signal may include an audible frequency band for the user. For example, the frequency band may be in the range of 20 Hz to 20 KHz. For example, when the sound output apparatus 1000 is used as a dedicated speaker for reproducing ultra-low sound, the speaker unit 1200 reproduces a bandwidth of an ultra-low band, for example, a bandwidth of 100 Hz or less.

The speaker unit 1200 is mounted in the case 1100 through the hole 1101 formed in the case 1100. The speaker unit 1200 further includes a fastening part 1300 between speaker unit 1200 and the case 1100. The speaker unit 1200 is secured to the case 1100 by the fastening part 1300.

The speaker unit 1200 may include a diaphragm 1210, a plate 1220, and a first magnet 1230. The speaker unit 1200 may further include a second magnet 1240. The speaker unit 1200 may further include a damper 1250.

The diaphragm 1210 may generate vibration to output sound. The diaphragm 1210 may generate vibration according to the movement of a coil (not shown). The diaphragm 1210 may output a sound signal by transmitting the vibration to the user's ear.

The plate 1220 supports the diaphragm 1210. A coil is formed inside the plate 1220. The coil is moved up and down by the first magnet 1230 as described above. Here, the coil includes a voice coil. The plate 1220 is formed of a material including metal to assist in this movement. For example, the plate 1220 may contain iron, aluminum, or the like.

The first magnet 1230 is a kind of magnetic circuit that induces the movement of the coil according to an electric signal. The first magnet 1230 moves the coil to vibrate the diaphragm 1210. In this operation, the first magnet 1230 may not generate vibration enough to output a sound signal. Accordingly, in order to enhance the output of the first magnet 1230, the speaker unit 1200 may further include a second magnet 1240.

The second magnet 1240 has the same function and material as the first magnet 1230. The second magnet 1240 may not be involved in generation of magnetic flux when the first magnet 1230 generates a necessary sufficient output. However, when the first magnet 1230 fails to provide a necessary sufficient output, the second magnet 1240 may assist the first magnet 1230 in generating a required magnetic flux.

The first magnet 1230 is formed to surround at least a portion of the plate 1220 on which the coil is provided in order to efficiently induce the movement of the coil. For example, the first magnet 1230 may be formed in a donut shape to surround the plate 1220, as shown in FIG. 4.

The second magnet 1240 may be spaced apart from the first magnet 1230 by a predetermined distance. The second magnet 1240 may be arranged on a side of the plate 1220 opposite to the diaphragm 1210. That is, the second magnet 1240 may be arranged at the rear of the speaker unit 1200. The second magnet 1240 is detachable from the speaker unit 1200.

As the first magnet 1230 and the second magnet 1240 are separately arranged to be spaced apart from each other by a predetermined distance, the sound output apparatus 1000 may supply sufficient magnetic flux required for sound output, while requiring lower cost than formation of one larger sized magnet.

The damper 1250 serves as a buffer when the diaphragm 1210 vibrates. The damper 1250 may be arranged between the diaphragm 1210 and the plate 1220 to support the diaphragm 1210. Specifically, the damper 1250 may be arranged between the diaphragm 1210 and the coil to support the diaphragm 1210 and the coil. The damper 1250 supports the coil such that the coil may move while maintaining the center of the magnetic gap.

The speaker unit 1200 may include two or more speaker units. For example, the speaker unit 1200 may include a first speaker unit 1201 and a second speaker unit 1202. The first speaker unit 1201 and the second speaker unit 1202 may be disposed to be spaced apart from each other by a preset distance. The first speaker unit 1201 and the second speaker unit 1202 output sound in opposite directions. That is, the first speaker unit 1201 and the second speaker unit 1202 are formed to be symmetrical to each other at opposite ends of the sound output apparatus 1000.

Accordingly, the sound output apparatus 1000 may cause the vibration generated from the rear of the first speaker unit 1201 and the vibration generated from the rear of the second speaker unit 1202 to cancel each other out. Specifically, the wave generated from the rear of the first speaker unit 1201 may meet the wave generated from the rear of the second speaker unit 1202. As the first speaker unit 1201 and the second speaker unit 1202 are arranged to face in opposite directions to each other, the wave generated from the rear of the first speaker unit 1201 and the wave generated from the rear of the second speaker unit 1202 travel in opposite directions toward each other.

In this regard, the first speaker unit 1201 and the second speaker unit 1202 may be arranged to be spaced apart from each other by a preset distance such that the waves from the speaker units may cancel each other out. The preset distance may be set in consideration of the frequency band of the sound output by the sound output apparatus 1000 through the speaker unit 1200. Due to such an arrangement, the waves generated from the first speaker unit 1201 and the second speaker unit 1202 may cancel each other out, and the magnitude of the total vibrations generated from the speaker unit 1200 may be reduced.

Due to the above-described structure, the sound output apparatus 1000 may reduce vibrations generated from the speaker unit 1200 while maintaining the quality of sound generated from the speaker unit 1200. In addition, the sound output apparatus 1000 may output a larger volume of sound by outputting sound using two or more speaker units 1200.

While FIG. 4 illustrates that the sound output apparatus 1000 has two speaker units 1201, 1202, the sound output apparatus 1000 may include two or more speaker units 1200 as mentioned regarding FIG. 3. That is, the sound output apparatus 1000 may include a plurality of speaker unit pairs each consisting of two speaker units. In this case, paired speaker units may be symmetrically and oppositely arranged to output sound in opposite directions. However, in the present disclosure, it is assumed that the sound output apparatus has two speaker units 1200 for simplicity.

Figure 5:
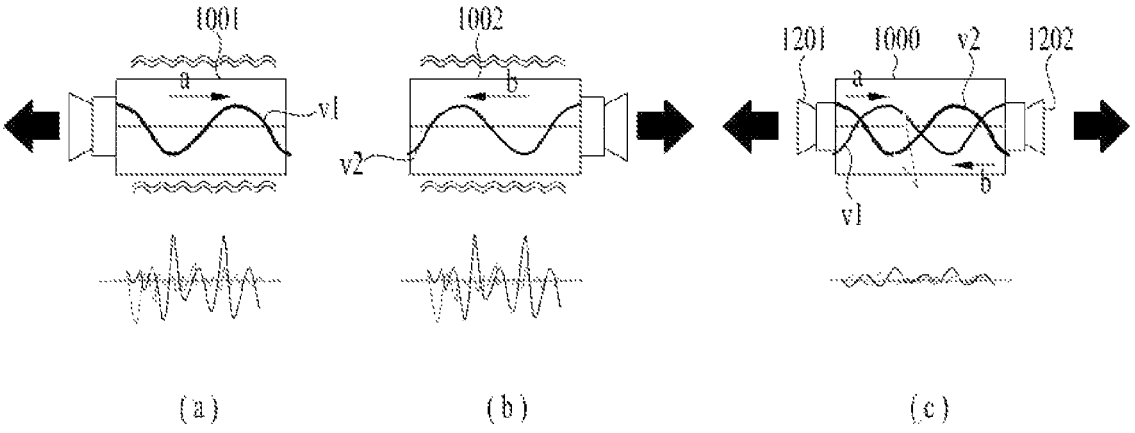
FIG. 5 is a view illustrates a vibration reduction effect of the sound output apparatus according to embodiments.

FIG. 5 is a view illustrates a vibration reduction effect of the sound output apparatus according to embodiments.

FIGS. 5-(*a*) and 5-(*b*) show conventional unidirectional sound output apparatuses 1001 and 1002. The unidirectional sound output apparatuses 1001 and 1002 may each include one speaker unit.

In FIG. 5-(*a*), the sound output apparatus 1001 generates at the rear a wave in direction a, which is the rearward direction of the speaker unit, according to the sound output. Accordingly, the vibration generated by the sound output apparatus 1001 is spread to the surrounding space without being canceled or reduced.

In FIG. 5-(*b*), the sound output apparatus 1002 generates at the rear a wave in direction b, which is the rearward direction of the speaker unit, according to the sound output. Thus, as in the case of the sound output apparatus 1001, the vibration generated by the sound output apparatus 1002 is spread to the surrounding space without being canceled or reduced.

FIG. 5-(*c*) illustrates a sound output apparatus 1000 according to embodiments of the present disclosure. The sound output apparatus 1000 according to the embodiments may include two or more speaker units 1201 and 1202 as described above. The two speaker units 1201 and 1202 may be symmetrically and oppositely arranged.

As shown in FIG. 5-(*c*), a rear of the first speaker unit 1201 may output a wave v1 in direction a, and a rear of the second speaker unit 1202 may output a wave v2 in direction b opposite to direction a. Accordingly, the waves v1 and v2 may be superposed with opposite phases. That is, destructive interference may occur in which the amplitude of the composite wave combining v1 and v2 is zero or close to zero.

Even when the amplitude of the composite wave is not 0, the sound output apparatus 1000 may absorb the vibration of a portion of the composite wave having a non-zero amplitude through the sound absorbing material described with reference to FIG. 4. Thereby, the sound output apparatus 1000 may further minimize the occurrence of vibration.

That is, unlike the conventional sound output apparatuses 1001 and 1002, the sound output apparatus 1000 according to the embodiments may minimize the amplitude of undesired waves that are produced toward a rear of each speaker unit even when outputting a complete sound signal toward a front of each speaker unit. The sound output apparatus 1000 may also minimize the vibration transmitted from the sound output apparatus 1000 to the surrounding space by the wave. Accordingly, the sound output apparatus 1000 may minimize inconvenience caused by unintentional or undesired vibrations from the sound output apparatus.

Hereinafter, specific numerical values capable of minimizing the occurrence of vibrations will be described with reference to FIGS. 6 and 7.

Figure 6:
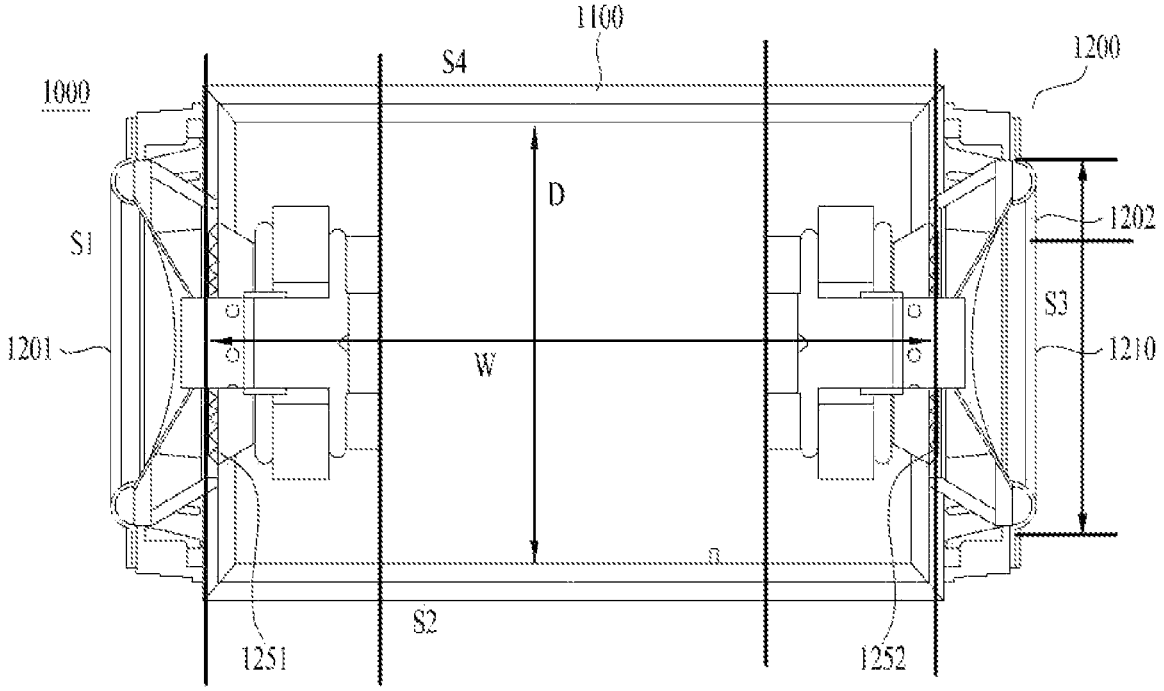
FIG. 6 is a sectional view of the sound output apparatus according to embodiments when viewed from the top.

FIG. 6 is a sectional view of the sound output apparatus according to embodiments when viewed from the top.

Figure 7:
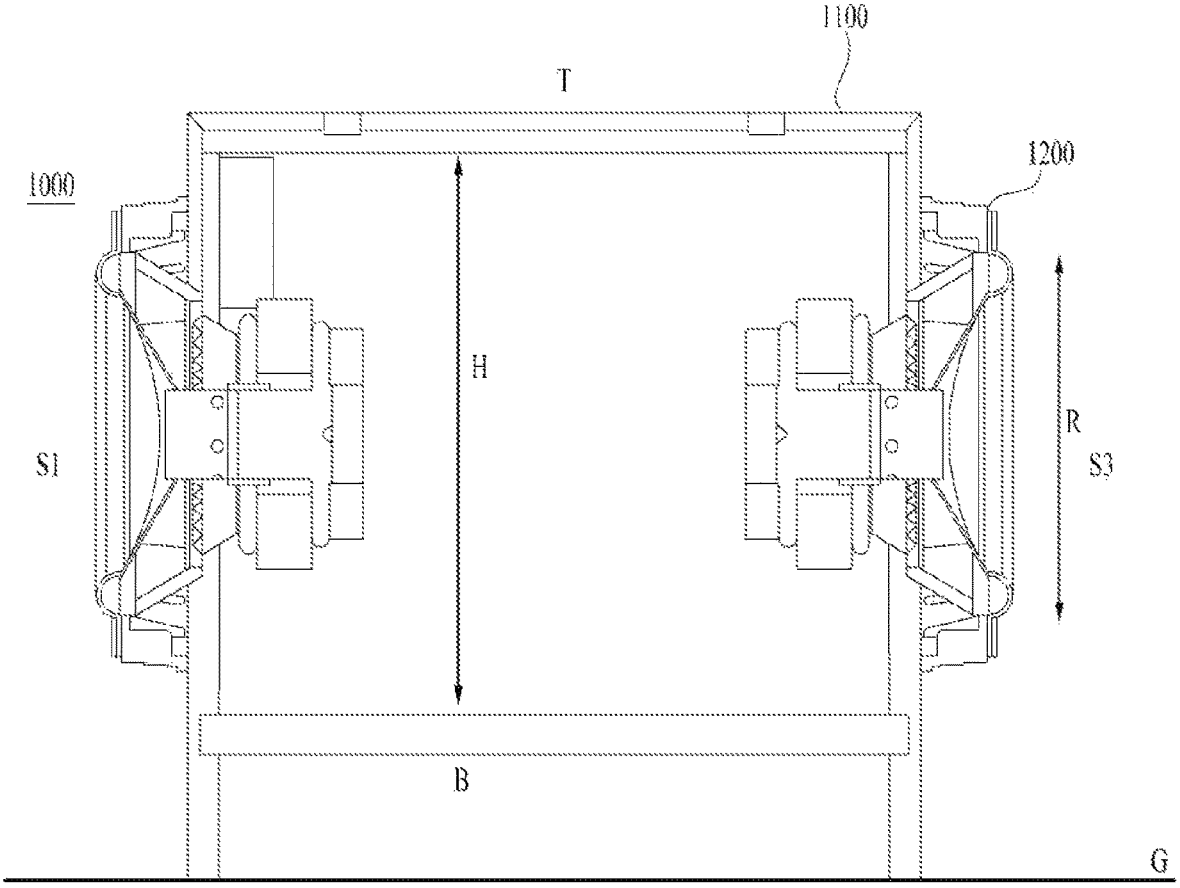
FIG. 7 is a cross-sectional view of the sound output apparatus according to embodiments when viewed from a side.

FIG. 7 is a cross-sectional view of the sound output apparatus according to embodiments when viewed from a side.

In FIG. 7, R, which denotes the diameter of the speaker unit 1200, is the diameter of the diaphragm 1210. That is, R is the distance from the edge of one side of the diaphragm 1210 to the edge of the opposite side facing the edge of the one side.

Also, in FIG. 6, W denotes the distance between the two speaker units 1201 and 1202. Specifically, W is the distance between the first damper 1251 included in the first speaker unit 1201 and the second damper 1252 included in the second speaker unit 1202. That is, W is the distance between the sound source of the first speaker unit 1201 and the sound source of the second speaker unit 1202. W is the preset distance described with reference to FIG. 4.

Also, in FIG. 6, D, which denotes the distance from one long lateral surface S2 of the case 1100 to the other long lateral surface S4 of the case 1101, represents the length of the case 1100 in the depth direction. That is, D is a distance from a point on the case 1100 on a long lateral surface (e.g., S2) to another point on the case 1100 on an opposite long lateral surface (e.g., S4). In the view of FIG. 6, the distance D may be parallel to the ground G (see FIG. 7).

In FIG. 7, H, which denotes the distance from the top surface T of the case 1100 to the bottom surface B of the case, is a height of the case 1100. That is, H is a distance from a point on the case 1100 on the top surface (e.g., T) to another point on the case 1100 on an opposite bottom surface (e.g., B). In the view of FIG. 7, the height measurement is perpendicular to the ground G.

The preset distance W may be greater than the diameter R of the speaker unit 1200. Specifically, the preset distance W may be greater than or equal to 1.9 times the diameter R of the speaker unit 1200 and less than or equal to 2.1 times the diameter R. This distance is a numerical value optimized to cancel waves traveling toward each other in opposite directions. In this case, for example, the bandwidth of the sound signal output from the speaker unit 1200 may be less than or equal to 100 Hz.

More specifically, the preset distance W may be twice the diameter R of the speaker unit 1200. This distance may be a value further optimized for canceling the waves traveling in the opposite directions.

As shown in FIG. 6, the first speaker unit 1201 and the second speaker unit 1202 of the speaker unit 1200 may be mounted on the short lateral surfaces S1 and S3 of the case 1100. Also in such embodiments, the speaker unit 1202 may not be mounted on the long lateral surfaces S2 and S4 of the case 1100. The case 1100 may be shaped such that the distance (e.g., W) between the short lateral surfaces S1 and S3 on which the speaker unit 1200 is mounted is longer than the distance (e.g., D) between the long lateral surfaces S2 and S4, which do not have the speaker unit 1200 mounted thereon.

The length D of the case 1100 in the depth direction may be greater than the diameter R of the speaker unit 1200. Specifically, the length D of the case 1100 in the depth direction may be greater than or equal to 1.25 times the diameter R of the speaker unit 1200 and less than or equal to 1.45 times the diameter R. By setting the distance as described above, the sound output apparatus 1000 may control the size of the space in which the wave travels.

More specifically, the length D of the case 1100 in the depth direction may be greater than or equal to 1.3 times the diameter R of the speaker unit 1200. Accordingly, the sound output apparatus 1000 may control the propagation directions of the waves generated by sound signals output from the rear of the speaker unit 1200 to be aligned on the same line. According to such a structure, the sound output apparatus 1000 may cause destructive interference between the sound signals according to the traveling directions of the waves. Thereby, the sound output apparatus 1000 may reduce vibration.

The length H of the case 1100 in the height direction may be greater than the diameter R of the speaker unit 1200. Specifically, the length H of the case 1100 in the height direction may be greater than or equal to 1.5 times the diameter R of the speaker unit 1200 and less than or equal to 1.9 times the diameter R. By setting the distance as described above, the sound output apparatus 1000 may control the amplitude of the wave generated from the speaker unit 1200.

More specifically, the length H of the case 1100 in the height direction may be 1.7 times the diameter R of the speaker unit 1200. Accordingly, the sound output apparatus 1000 may control the amplitude of each wave such that the waves generated when the speaker unit 1200 outputs sound signals may properly cancel each other. Thereby, the sound output apparatus 1000 may reduce vibration.

Figure 8:
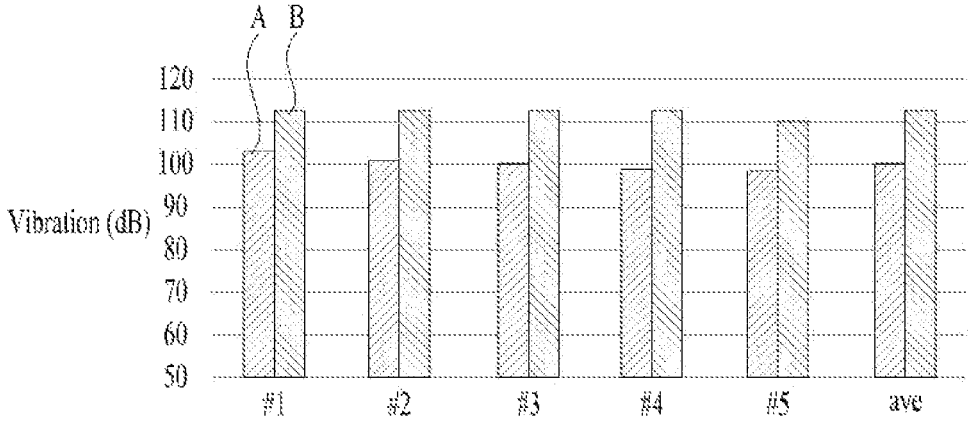
FIG. 8 is an experimental graph depicting technical effects of the sound output apparatus according to embodiments.

FIG. 8 is an experimental graph depicting technical effects of the sound output apparatus according to embodiments.

In FIG. 8, A represents a result value for the sound output apparatus according to the embodiments, and B represents a result value for the conventional sound output apparatus. Also, FIG. 8 is a graph depicting measured magnitudes (in dB) of vibrations for A and B in five experiments #1 to #5, and averages thereof.

As shown in FIG. 8, on average, the magnitude of the vibration according to A may be less than the magnitude of the vibration according to B by about 10 dB. In general, a deviation of noise by an average of 10 dB more is perceptible to a user. Also, in general, the user's ear may perceive a first noise that is 10 dB higher than a second noise as being about twice as loud.

Accordingly, the technical effect of vibration reduction of the sound output apparatus 1000 according to the embodiments may be clearly understood from the results shown in FIG. 8.

Figure 9:
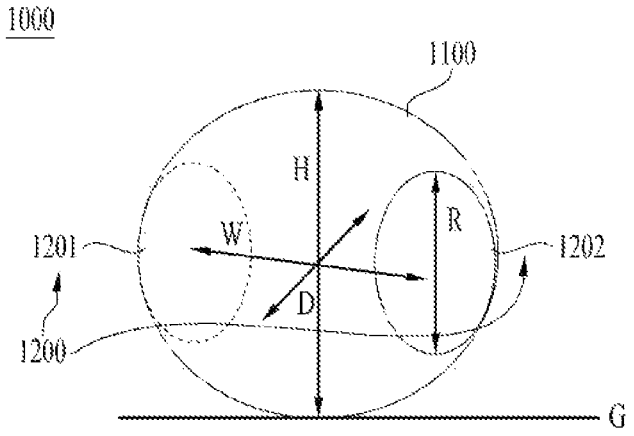
FIG. 9 is a view illustrating another example of a shape of the sound output apparatus according to embodiments.

FIG. 9 is a view illustrating another example of a shape of the sound output apparatus according to embodiments.

The sound output apparatus 1000 according to the embodiments may have an ellipsoid shape. The sound output apparatus 1000 may include a case 1100 and a speaker unit 1200. The speaker unit 1200 may include a first speaker unit 1201 and a second speaker unit 1202. The first speaker unit 1201 and the second speaker unit 1202 may be spaced apart from each other by a preset distance W, and output sound signals in opposite directions.

In FIG. 9, W denotes the distance between the two speaker units 1201 and 1202. H denotes the length of the case 1100 in the height direction. D denotes the length of the case 1100 in the depth direction. R denotes the diameter of the speaker unit 1200.

The relationship between R, D, H, and W of the sound output apparatus 1000 shown in FIG. 9 may be the same as that described with reference to FIGS. 4 to 7. As such, the sound output apparatus 1000 may have any shape as long as it includes two or more speaker units 1200 arranged to be symmetrical and oppositely positioned to each other. Specifically, the sound output apparatus 1000 may have any shape including a plurality of speaker unit pair each having two symmetrically and oppositely arranged speaker units.

Although not shown in the figure, the sound output apparatus 1000 may include a housing arranged to surround the case 1000. The housing may include a first housing and a second housing. The first housing may be arranged to surround the case 1000, and the second housing may be arranged to surround the first housing.

In this case, each of the first housing and the second housing are designed to have a preset thickness that is less than when only one housing is used. As the housing is configured with two separate bodies, the sound output apparatus 1000 may address the issue of deformation of the housing, which may occur when the apparatus is used for a long time.

The sound output apparatus according to the embodiment may reduce vibrations generated from the symmetrically and oppositely arranged speaker units by causing the vibrations generated from the rear of each of the speaker units to cancel each other out.

As is apparent from the above description, the present disclosure has an effect as follows.

Embodiments may provide a sound output apparatus that generates reduced vibration.

It will be appreciated by persons skilled in the art that that the effects that can be achieved through the embodiments of the present disclosure are not limited to those described above and other advantageous effects of the present disclosure will be more clearly understood from the following detailed description.

Specific embodiments of the sound output apparatus according to the present disclosure have been described. However, it should be noted that the embodiments are merely exemplary, and embodiments of the present disclosure are not limited thereto. Thus, the present invention should be construed as having the widest scope corresponding to the principles and novel features disclosed herein.

A person skilled in the art may practice unspecified embodiments by combining or substituting the disclosed embodiments, without departing from the scope of the present disclosure. It will be apparent to those skilled in the art that various modifications and variations can be made in the present disclosure without departing from the spirit or scope of the invention. Thus, it is intended that the present disclosure cover the modifications and variations of this invention provided they come within the scope of the appended claims and their equivalents.

What is claimed is:

1. A sound output apparatus comprising:

a case including a first opening and a second opening positioned on opposite sides of the case; and a first speaker mounted to the case at the first opening and the second speaker mounted to the case at the second opening such that the first speaker and the second speaker are symmetrically arranged and face opposite directions, wherein the first speaker and the second speaker are spaced apart from each other by a preset distance such that respective sound vibrations generated at a rear of the first speaker and a rear of the second speaker cancel each other out.

2. The sound output apparatus of claim 1, wherein the preset distance is greater than a diameter of the first and second speakers.

3. The sound output apparatus of claim 1, wherein the preset distance is greater than or equal to 1.9 times a diameter of the first and second speakers and less than or equal to 2.1 times the diameter.

4. The sound output apparatus of claim 1, wherein the preset distance is approximately twice a diameter of the first and second speakers.

5. The sound output apparatus of claim 1, wherein a lateral depth distance of the case perpendicular to an axis of measurement of the preset distance is greater than a diameter of the first and second speakers.

6. The sound output apparatus of claim 5, wherein the lateral depth distance is greater than or equal to 1.25 times the diameter and less than or equal to 1.45 times the diameter.

7. The sound output apparatus of claim 6, wherein the lateral depth distance is approximately 1.3 times the diameter.

8. The sound output apparatus of claim 5, wherein the lateral depth distance is greater than or equal to 1.5 times the diameter and less than or equal to 1.9 times the diameter.

9. The sound output apparatus of claim 8, wherein the lateral depth distance is approximately 1.7 times the diameter.

10. The sound output apparatus of claim 1, wherein each of the first and second speakers comprises:

a diaphragm configured to vibrate;

a plate configured to support the diaphragm; and a first magnet arranged to surround at least a portion of the plate.

11. The sound output apparatus of claim 10, wherein each of the first and second speakers further comprises:

a second magnet disposed at a rear of the plate and arranged to face the diaphragm.

12. The sound output apparatus of claim 10, wherein each of the first and second speakers further comprises:

a damper arranged between the diaphragm and the plate and configured to support the diaphragm.

13. The sound output apparatus of claim 1, further comprising:

a sound absorbing member provided inside the case to absorb sound generated from the first and second speakers.

* * * * *